US006701810B2

(12) United States Patent
Adamczyk et al.

(10) Patent No.: US 6,701,810 B2
(45) Date of Patent: Mar. 9, 2004

(54) RADIATOR CAP TOOL

(75) Inventors: Walter D. Adamczyk, Warren, MI (US); Kewal K. Chopra, Sterling Heights, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/261,179

(22) Filed: Oct. 1, 2002

(65) Prior Publication Data

US 2003/0029280 A1 Feb. 13, 2003

Related U.S. Application Data

(63) Continuation-in-part of application No. 09/903,271, filed on Jul. 12, 2001, now abandoned.

(51) Int. Cl.[7] ..... B25B 13/56
(52) U.S. Cl. ..... 81/176.15; 81/176.3; 81/3.42
(58) Field of Search ..... 81/176.1, 176.15, 81/176.2, 176.3, 461, 3.4, 3.41, 3.07, 3.42, 163

(56) References Cited

U.S. PATENT DOCUMENTS

| | | | | | |
|---|---|---|---|---|---|
| 317,038 | A | * | 5/1885 | Strait | 81/3.41 |
| 761,523 | A | * | 5/1904 | Miller, Jr. | 81/176.3 |
| 970,371 | A | * | 9/1910 | Greggs | 81/176.2 |
| 4,336,729 | A | * | 6/1982 | Eppenbach | 81/439 |
| 6,116,120 | A | * | 9/2000 | Boe | 81/163 |

* cited by examiner

*Primary Examiner*—D. S. Meislin
(74) *Attorney, Agent, or Firm*—David L. Kuhn; Gail S. Soderling; Clifford C. Carter

(57) ABSTRACT

A radiator cap tool for removing a radiator cap comprising a base member that has at least two axially aligned rectangular apertures. A socket drive is disposed on one side to receive the drive portion of a socket handle. Two detents are disposed in the apertures extending orthogonally from the base member to form a gap on the side of the base member opposite the socket drive member. The detents are adjustable to vary the gap between the detents for use on various sized caps.

1 Claim, 3 Drawing Sheets

RADIATOR CAP TOOL

CROSS REFERENCE TO RELATED APPLICATIONS

This application is a continuation-in-part of co-pending application Ser. No. 09/903,271 Jul. 12, 2001, now abandoned.

GOVERNMENT INTEREST

The invention described here may be made, used and licensed by The United Sates government for all governmental purposes without paying us any royalty.

BACKGROUND OF THE INVENTION

1. Field of the Invention

In one aspect this invention relates to automotive tools. More particularly it relates to tools used to remove radiator caps.

2. Prior Art

In general many different radiator cap removal devices have been proposed. They range from relatively simple to quite complex. One example of a simple structure is found in U.S. Pat. No. 4,846,025. This device shows a single piece tool with a hollow handle that can be gripped by hand and a flanged hollow face. The flange is formed with a recess in the flange, the recess being shaped with openings and indentations so as to grip a radiator cap. The device allows a cap to be removed and the flange covering the cap will provide a measure of protection.

A second device is shown in U.S. Pat. No. 5,199,327 which has a U-shaped bail attached to a base with screws that can be used to attach the device to a radiator cap for removal. The U-shaped bail provides a good griping device that can provide a substantial amount of torque to the radiator cap for removal.

Yet a third structure is shown in U.S. Pat. No. 4,805,493. This device has elongated tongs with a shaped cap enclosing, gripping jaws on one end. This device allows a cap to be gripped and turned from a distance of up to several feet.

The prior art devices provide a variety of different means to grip and remove a radiator cap having various degrees of adjustment and substantial robustness. What is desired is a strong robust tool, which can be adjusted to closely fit a wide range and style of radiator caps. The tool can be formed so it can be engaged by a common socket wrench to provide good twisting action to the radiator cap and thereby remove the cap.

SUMMARY OF THE INVENTION

Briefly the present invention is an improved robust radiator cap tool. It comprises a base member having a socket drive member disposed on one side, the socket drive member being adapted to receive the drive portion of a socket handle to allow a twisting motion to be applied to the socket drive member. A pair of adjustable detents are disposed on the side of the base member opposite the socket drive, the detents extending orthogonally to the base member to form a gap on the side of the base member opposite the ratchet drive member. The detents are mounted on the base member so as to be adjustable to vary the gap so it can snuggly grip a variety of different diameter radiator caps.

DETAILED DESCRIPTION

Figure 1:
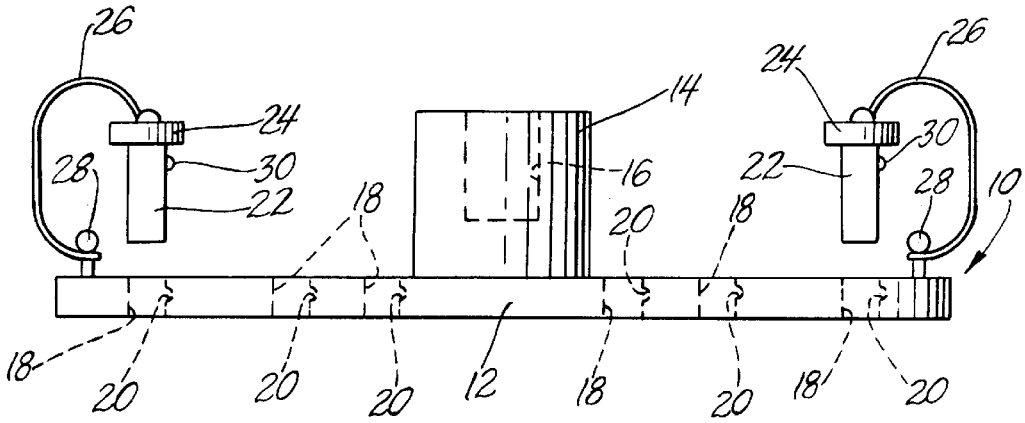
FIG. 1 is a side view of one embodiment of this invention.

Referring to the accompanying drawing in which like numerals refer to like parts and initially to FIG. 1, a radiator cap removal tool according to this invention is designated generally as 10. The tool 10 has a base member 12 with a socket drive 14 disposed on one side or surface which has a square aperture 16 formed to receive the drive portion of a socket wrench handle. Such wrench handles are known in the art and further description is omitted in the interest of brevity since they form no part of this invention.

Figure 2:
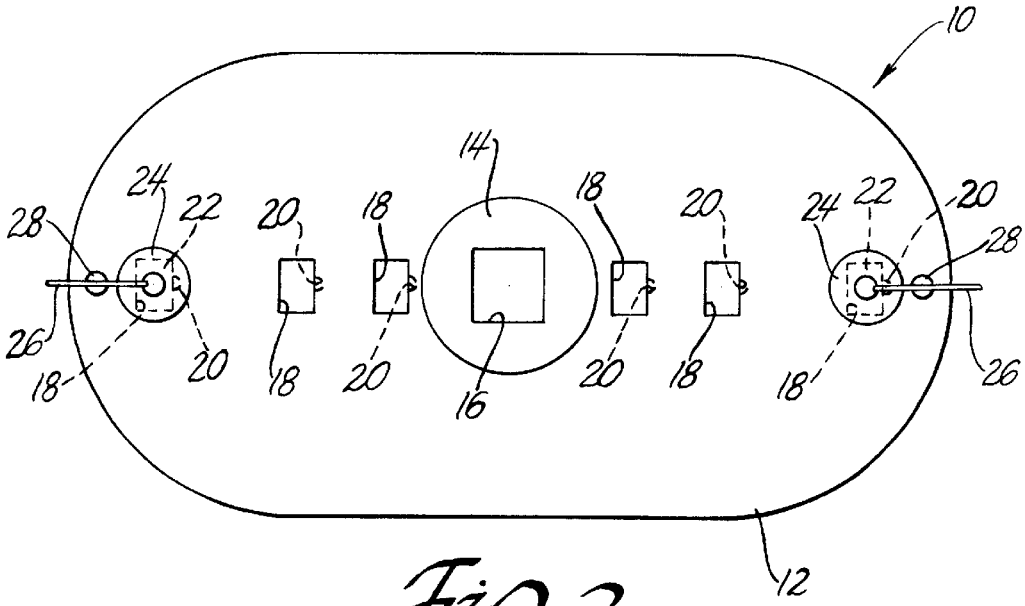
FIG. 2 is a top view of the embodiment of FIG. 1.

The base member 12 has at least one rectangular aperture on each side of the socket drive. As shown in FIG. 1, there are a plurality of rectangular apertures 18 which are arranged in a spaced linear array and equally divided on either side of the socket drive. As shown in FIG. 2, there are three rectangular apertures 18 disposed on each side of the socket drive 14. The rectangular apertures 18 have a small depression 20 on one sidewall for use as will be explained later.

The radiator cap removal tool has a pair of pins 22, formed with a rectangular cross section complimentary to the cross section of apertures 18, attached to the base 12. Each pin 22 is formed with a head 24 and has the head attached to a line 26, the line being attached to an anchor post 28, one anchor post being associated with each set of apertures 18. The anchor posts 28 are located on opposite sides of the drive socket 14 on the same face of the base member 12. The pins 22 have a spring-loaded, ball 30 of standard design, which will engage sidewall depression 20, when the pin 22 is inserted into rectangular aperture 18, the ball 30 serving to firmly hold the pins 22 in place. The pins 22 are of sufficient length that when they are inserted into the rectangular apertures 18 they will extend through the base member 12 and form detents extending orthogonally from the base member 12 on the side of the base member opposite the socket drive 14. The resulting spaced detents extend from the base 12 and form a gap. The pins 22 will be positioned in the rectangular apertures 18 so as to span the diameter of a particular radiator cap (not shown) to be removed, but small enough to firmly engage the lobes extending from the periphery of such caps when the base member 12 is rotated. The provision of a plurality of rectangular apertures 18 allows the pins 22 to be mounted in the base member 12 so the gap will fit snuggly and grip a wide variety of radiator cap sizes and shapes.

Figure 4:
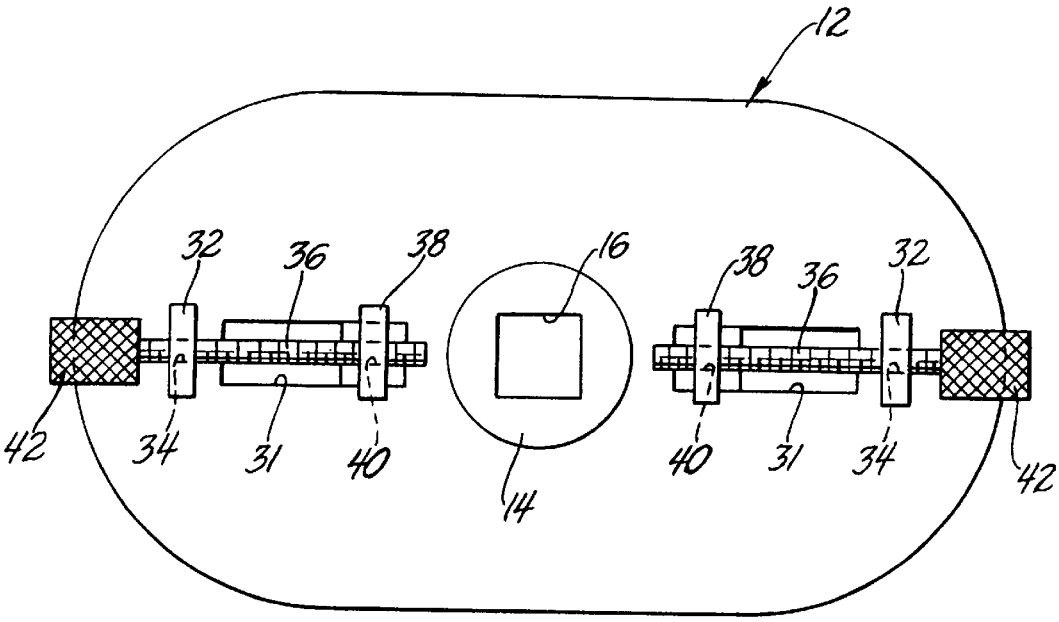
FIG. 4 is a top view of the embodiment of FIG. 3.
Figure 3:
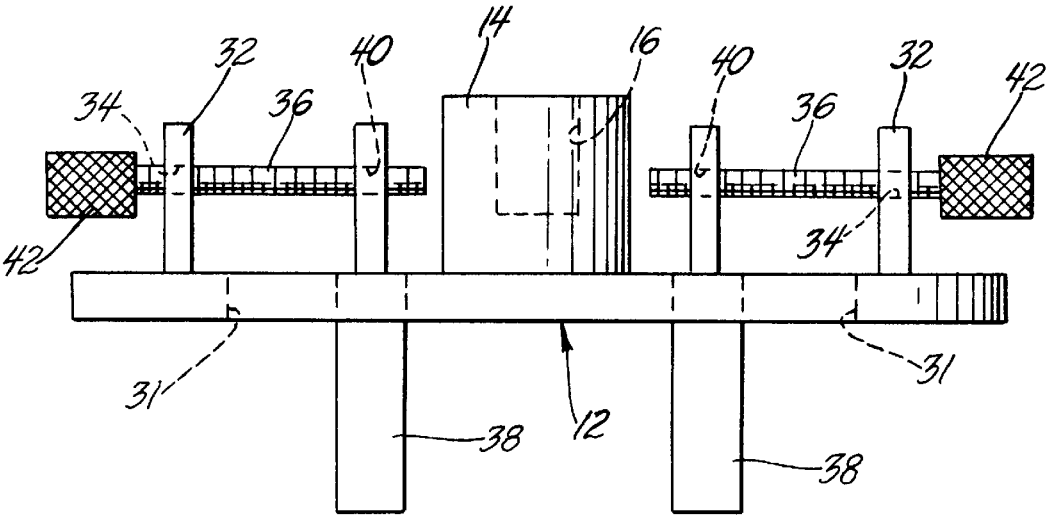
FIG. 3 is a side view of a second embodiment of this invention.

A second embodiment of the invention is shown in FIGS. 3 and 4. In this embodiment, the base member 12 has two axially aligned, elongated rectangular slots 31 formed along the longitudinal axis of the base member. The socket drive 14 is disposed on one side of the base member 12 located between the rectangular slots 31. A pair of pintles 32 are mounted on base member 12 one pintle being associated with each of the rectangular slots 31 and being located near opposite ends of the base member. Thus, the pintles 32 are mounted juxtaposed the ends of the slots furthest from the socket drive 14. Pintles 32 are formed with an aperture 34 having its axis parallel to the longitudinal axis of the rectangular slot 31. Each pintle 32 has an elongated threaded drive 36 journaled in its aperture 34, the threaded drive having its longitudinal axis parallel to the surface of the base plate, and the rectangular slot 31.

Each elongated threaded drive 36 has an associated moveable pin 38, with a threaded aperture 40 the aperture's threads being complimentary to and mateing with threaded drive 36. The pins 38 have a rectangular cross-section that allows longitudinal movement of the pins 38 within the associated rectangular slot 31. The pins 38 cross section allows its longitudinal movement along the slot 31 but prevents the pin 38 from twisting within the slot when a force is applied to one side of the pin as might happen when a twisting force is applied to a radiator cap when used. The pins 38 extend orthoganally from the threaded drive 36 through the slot 31 and project beyond the base member 12 extending so as to form a gap between the pins on the side of the base member 12 opposite the socket drive 14.

The gap between the pins 38 can be modified by rotating the threaded drive 36 using a knurled head 42 which moves the pins 38 longitudinally along the slot 31 to the desired spacing. That portion of the pins 38 extending past the base member 12 act as the adjustable detents of this embodiment which can be used to engage the lobes on a radiator cap. The use of threaded drives 36 as shown will allow the gap to be adjusted with infinite variability between the widest and narrowest positions.

Figure 6:
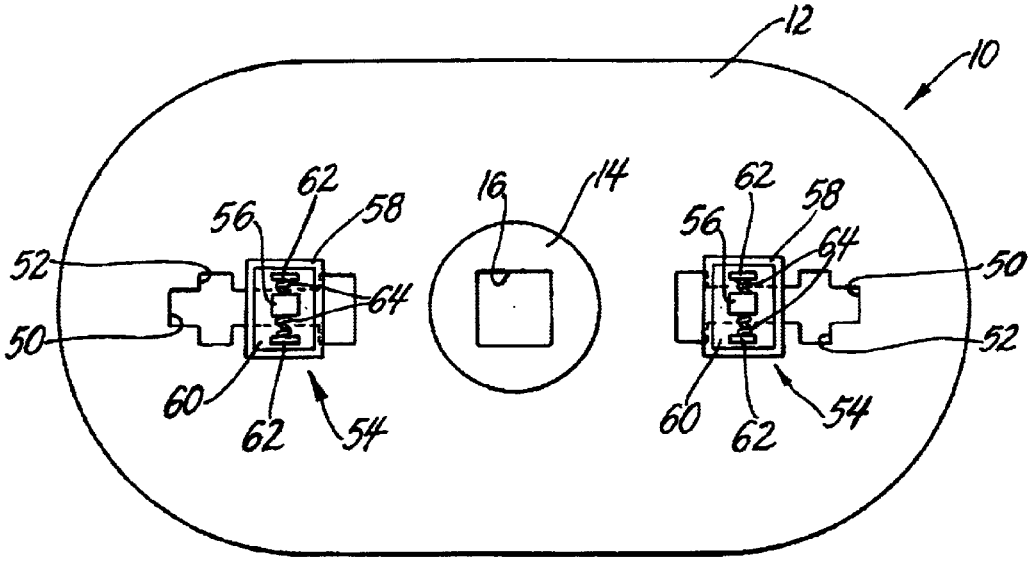
FIG. 6 is a top view of the embodiment of FIG. 5.
Figure 5:
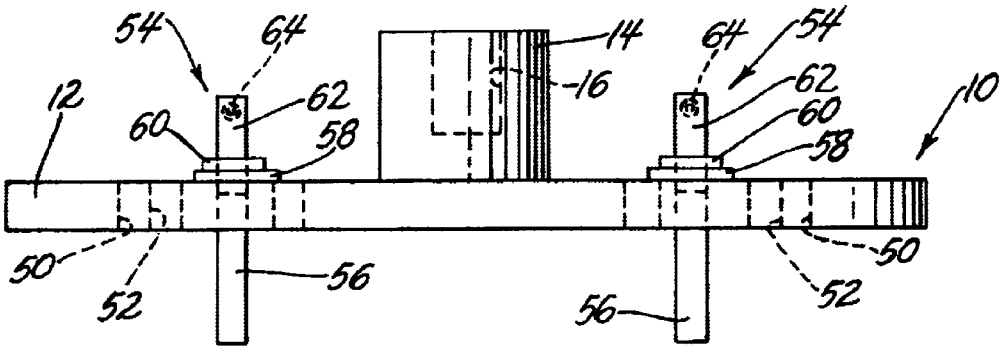
FIG. 5 is a side view of another embodiment of this invention.
Figure 7:
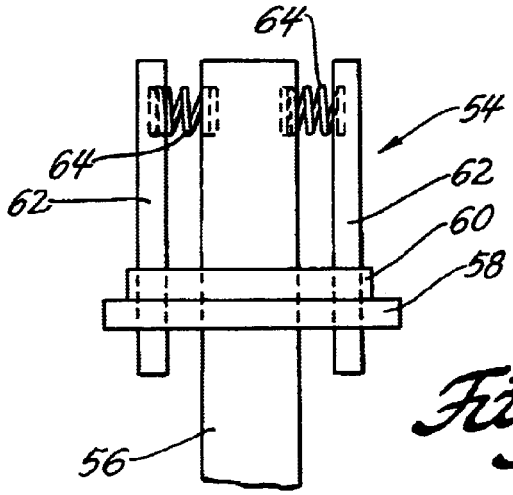
FIG. 7 is an enlarged view of the detent mechanism used in FIG. 5.

Turning to FIGS. 5, 6 and 7, a third embodiment of the invention is presented. In this embodiment, the base 12 has two cruciate slots 50 formed with their longitudinal axes aligned with the longitudinal axis of the base member 12. A plurality of paired cross arms 52 extend orthogonally outward from the longitudinal axis of the cruciate slot 50. The cruciate slots 50 shown are formed with three sets of the paired arms 52 which provide three separate and distinct points for placement of a spring loaded pin 54 on each side of the drive socket 14. This structure will provide several different spring pin 54 positions.

The detailed structure of an individual spring-loaded pin 54 is shown in greater detail in FIG. 7. The spring-loaded pin 54 has a rectangular center portion 56 adapted to fit and move easily along the longitudinal axis of the cruciate slot 50. The center portion 56 has a crossbeam 58 mounted thereon the crossbeam having rectangular openings. The cross beam 58 is larger than the cruciate slot so as to prevent the pin from passing through the base 12 once the spring loaded pin 54 is positioned in the base 12. A further support plate 60 having rectangular openings is attached to the crossbeam 58, the support plate having openings, which correspond to the openings in cross beam 58.

A pair of moveable, spring loaded legs 62 are disposed with one leg on each side of center portion 54. The legs 62 extend parallel to the center portion 56 and are biased outwards away from the center portion by associated springs 64 one spring being attached to each leg 62. The spring loaded pin 54 is sized so the spring loaded legs 62 can be collapsed and moved to a position near center portion 54 to reduce the cross sectional area allowing the entire structure to be moved longitudinally along the cruciate slot 50 to another position where the cross arms 52 extend outward and are then released the arms 62 expanding the cross section of the pin 54 into the cross arms to hold the pin 54 in place.

Various alterations and modifications will become apparent to those skilled in the art without departing from the scope and spirit of this invention and it is understood this invention is limited only by the following claims.

What is claimed is:

1. A radiator cap tool for removing a radiator cap comprising:

a base member having two axially aligned cruciate apertures, the cruciate apertures being aligned with the longitudinal axis of the base member, one cruciate aperture located on each side of a socket drive centrally located on the base member, the cruciate apertures having a plurality of paired cross arms extending orthogonally from the cruciate apertures the socket drive adapted to receive the drive portion of a socket handle to allow a rotary motion to be applied to the base member;

two pins selectively positioned in the cross arms of the cruciate slots, each pin comprising a rectangular center portion adapted to move easily along the longitudinal axis of the associated cruciate slot, a cross beam mounted on the center portion, the cross beam having rectangular openings, a pair of legs, one leg being mounted on each side of the center portion on an associated spring and extending parallel to the center portion through the openings in the cross beams, the legs being normally biased by the springs to an extended position where the legs engage the cross arms of the cruciate slot, the legs being collapsible to a position near the center portion to allow movement of the pin along the cruciate slot, the center portion of the pins extending through the base member to provide two detents with a gap suitable for engaging the ears of the radiator cap to effect removal of the cap.

* * * * *